United States Patent [19]

Balkus

[11] 4,396,047

[45] Aug. 2, 1983

[54] ELECTRIC WOOD SPLITTER

[76] Inventor: Carl E. Balkus, 176 Deepwood Dr., Amston, Conn. 06231

[21] Appl. No.: 269,375

[22] Filed: Jun. 1, 1981

[51] Int. Cl.[3] ..... B27L 7/00

[52] U.S. Cl. ..... 144/193 R; 254/103

[58] Field of Search ..... 125/23 R; 254/DIG. 2, 254/98, 103; 144/193 R

[56] References Cited

U.S. PATENT DOCUMENTS 1,283,195 10/1918 Hunter ..... 144/193 R
3,514,090 5/1970 Wvesthoff ..... 254/103
4,121,636 10/1978 James ..... 144/193 R
4,141,395 2/1979 Arzt ..... 144/193 R

*Primary Examiner*—W. D. Bray
*Attorney, Agent, or Firm*—McCormick, Paulding & Huber

[57] ABSTRACT

A device for splitting wood including worm driven parallel threaded shafts, which shafts mount the wood splitting wedge. Threaded nut means cooperate with the shafts and with the splitting wedge for effecting movement of the wedge along the shafts. A box frame is provided for supporting the wood to be split and for mounting the parallel shafts therein.

4 Claims, 4 Drawing Figures

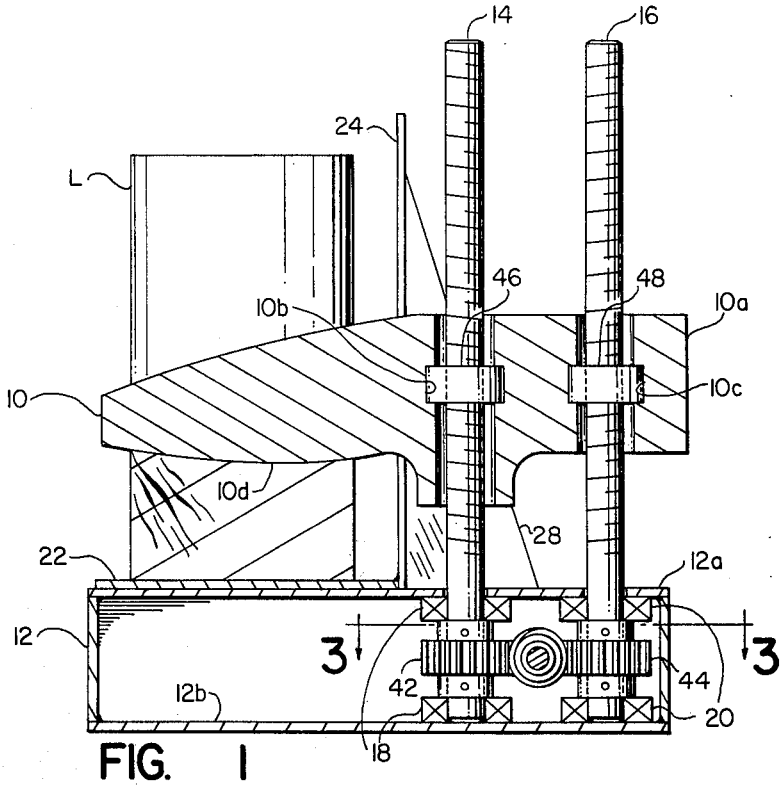
FIG. 1
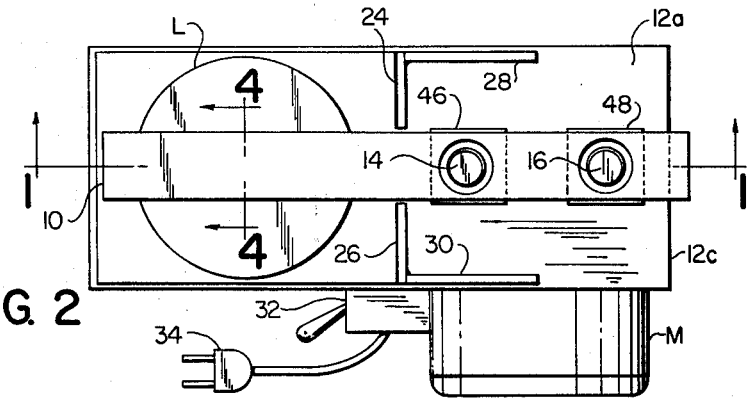
FIG. 2
FIG. 4
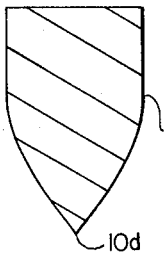
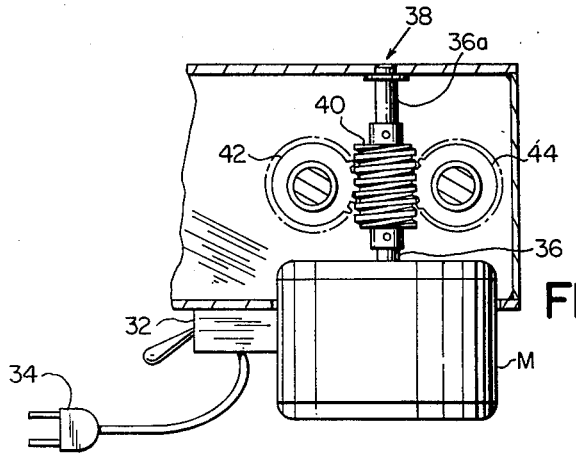
FIG. 3

ELECTRIC WOOD SPLITTER

This invention relates generally to power driven devices for splitting firewood or the like, and deals more particularly with an electrically driven device having a unique configuration for movably supporting the wood splitting blade. The general object of the present invention is to provide an inexpensive wood splitting device of the type adapted to be driven from a readily available source of energy such as electricity for example, and it is a feature of the present invention that the device is very economical, such a device being well adapted to low cost high quantity mass production.

In carrying out these objects a wood splitting device of the present invention includes electric motor means, a worm gear provided on the motor's drive shaft, parallel left and right hand threaded screw shafts oriented in a plane perpendicular to the axis of the motors drive shaft and having two spur gears meshing with this single worm gear to achieve counter-rotation of these left and right hand threaded shafts. Captured left and right hand threaded nuts are provided in the wood splitting blade itself so as to achieve linear motion of the blade in response to rotation of the left and right hand threaded jack screw shafts. A reversing switch is provided for achieving return movement of the blade and a shield is provided between the wood to be split and the jack screws to protect these threaded screws from the material being split due to splintering or the like of the wood being split.

FIG. 1 is a vertical sectional view taken generally on the 1—1 of FIG. 2.

FIG. 2 is a top plan view of the apparatus illustrated in FIG. 1.

FIG. 3 is a horizontal sectional view taken generally on the line 3—3 of FIG. 1.

FIG. 4 is a sectional view taken on the line 4—4 of FIG. 2.

Turning now to the drawing in greater detail, FIG. 1 shows a wood splitting device constructed in accordance with the present invention, and said device includes a wood splitting blade 10, shown in intermediate position in the process of splitting a log L. The log is supported on a base 12 comprising a box-like frame consisting of a generally horizontal upper plate 12*a* welded by means of side walls to a bottom plate 12*b* so as to provide a convenient structure for supporting two vertically extending jack screws 14 and 16 rotatably mounted in spaced sets of bearings 18 and 20. These jack screws 14 and 16 are parallel to one another and oriented in a vertical plane through which the blade 10 is adapted to move as its cutting edge 10*d* splits the log L as shown.

The lower ends of the jack screws 14 and 16 carry spur gears 42 and 44, which gears 42 and 44 mesh with a worm gear 40 located between these spur gears 42 and 44 on the drive shaft 36 associated with electric motor M. The motor M is held in the base 12 by a suitable means (not shown) and associated with the motor M is a reversing switch 32 which may also include means for selectively turning power to the motor M on and off. The motor M is thus adapted to be electrically connected to a source of power by means of plug 34.

The wood splitting blade 10 includes a portion 10*a* having vertically oriented openings through which the jack screws 14 and 16 extend. Communicating with these cylindrical openings in the blade base portion 10*a* are rectangular openings 10*a* and 10*b*, which are adapted to retain left and right hand threaded nuts 46 and 48 respectively, as best shown in FIG. 1. These nuts 46 and 48 achieve vertical motion of the blade 10 in a response to counter-rotational motion of the jack screws 14 and 16. The generally square openings 10*b* and 10*c* for so supporting the nuts 46 and 48 respectively are illustrated to best advantage in FIGS. 1 and 2.

As so constructed and arranged the device of the present invention is well adapted to split logs, such as shown at L in the drawing, by reason of vertical downward motion of the blade 10 in response to rotation of the motor M and its drive shaft 36 in a particular direction. Reversing the motor M, through switch 32, will permit return movement of the blade 10 so as to allow splitting of further workpieces or logs L. The blade 10 may be a solid member, as shown in FIG. 4, with a lower cutting edge 10*d*, or in the alternative may comprise a welded up structure (not shown) where it is desired to manufacture the present apparatus for use in splitting lighter weight logs, or to permit the blade 10 to be made of lighter weight material for reducing the cost of the device itself. As suggested in FIG. 3 the drive shaft 36 may extend across the box-like frame 12 in order to permit the free end portion 36*a* of the drive shaft 36 to be supported at its free end portion 36*a* in an opening as suggested at 38 in this view.

I claim:

1. A wood splitting device comprising motor means, a drive shaft driven by said motor means, parallel jack screw shafts oriented in a plane perpendicular to the axis of said driven shaft, gear reduction means coupling said drive shaft to said jack screw shafts to cause counter-rotation of said jack screw shafts in response to rotation of said driven shaft, one of said jack screw shafts having a right hand threaded portion and another of said jack screw shafts having a left hand threaded portion, right hand threaded nut means on said right hand threaded jack screw shaft and left hand threaded nut means on said left hand threaded jack screw shaft, a wood splitting blade having a portion which non-rotatably supports said left and right hand threaded nut means so that said blade moves linearly in the plane of said counter rotating left and right hand threaded jack screw shafts in response to rotation of said jack screw shafts, a fixed frame including a base for supporting the wood to be split, and bearing means in said frame for rotatably supporting said counter-rotating jack screws.

2. The wood splitter according to claim 1 further characterized by means for reversing the direction of rotation of said driven shaft to achieve return movement of said blade.

3. The wood splitter according to claim 2 wherein said gear reduction means comprises a worm gear on said drive shaft and spur gears on said jack screw shafts and meshing with said worm gear to drive said jack screw shafts in opposite directions but at corresponding speeds of rotation.

4. The wood splitter according to claim 3 further characterized by shield means for shielding said jack screws shafts from the wood to be split, said shield means comprising laterally spaced brackets located in spaced relationship to receive said movable blade therebetween, each said bracket having a lower end attached to said base.

* * * * *